United States Patent [19]

Knoll et al.

[11] 4,353,010

[45] Oct. 5, 1982

[54] TRANSISTOR DRIVE SCHEME FOR FLUORSCENT LAMP BALLAST

[75] Inventors: William C. Knoll, Turbotville; David L. Bay, Muncy, both of Pa.

[73] Assignee: GTE Products Corporation, Stamford, Conn.

[21] Appl. No.: 218,388

[22] Filed: Dec. 19, 1980

[51] Int. Cl.[3] ..... H05B 41/29

[52] U.S. Cl. ..... 315/220; 315/105; 315/277; 315/278; 315/DIG. 7

[58] Field of Search ..... 315/209 R, 219, 220, 315/105, 106, 276–278, DIG. 7

[56] References Cited

U.S. PATENT DOCUMENTS 4,075,476 2/1978 Pitel ..... 315/278 X 4,188,661 2/1980 Bower et al. ..... 315/220 X

*Primary Examiner*—Eugene R. LaRoche

*Attorney, Agent, or Firm*—John A. Odozynski

[57] ABSTRACT

An improved drive scheme for a pair of push-pull inverter transistors in an electronic ballast circuit. The inverter output is coupled through a series resonant circuit comprising a capacitor and the primary winding of an output transformer. The resonant circuit is coupled to the inverter output through an additional winding on the primary of an interstage so that a component of the loop current is fed back to the bases of the push-pull transistors, thereby compensating for phase errors in the drive signal applied at the inverter input.

2 Claims, 1 Drawing Figure

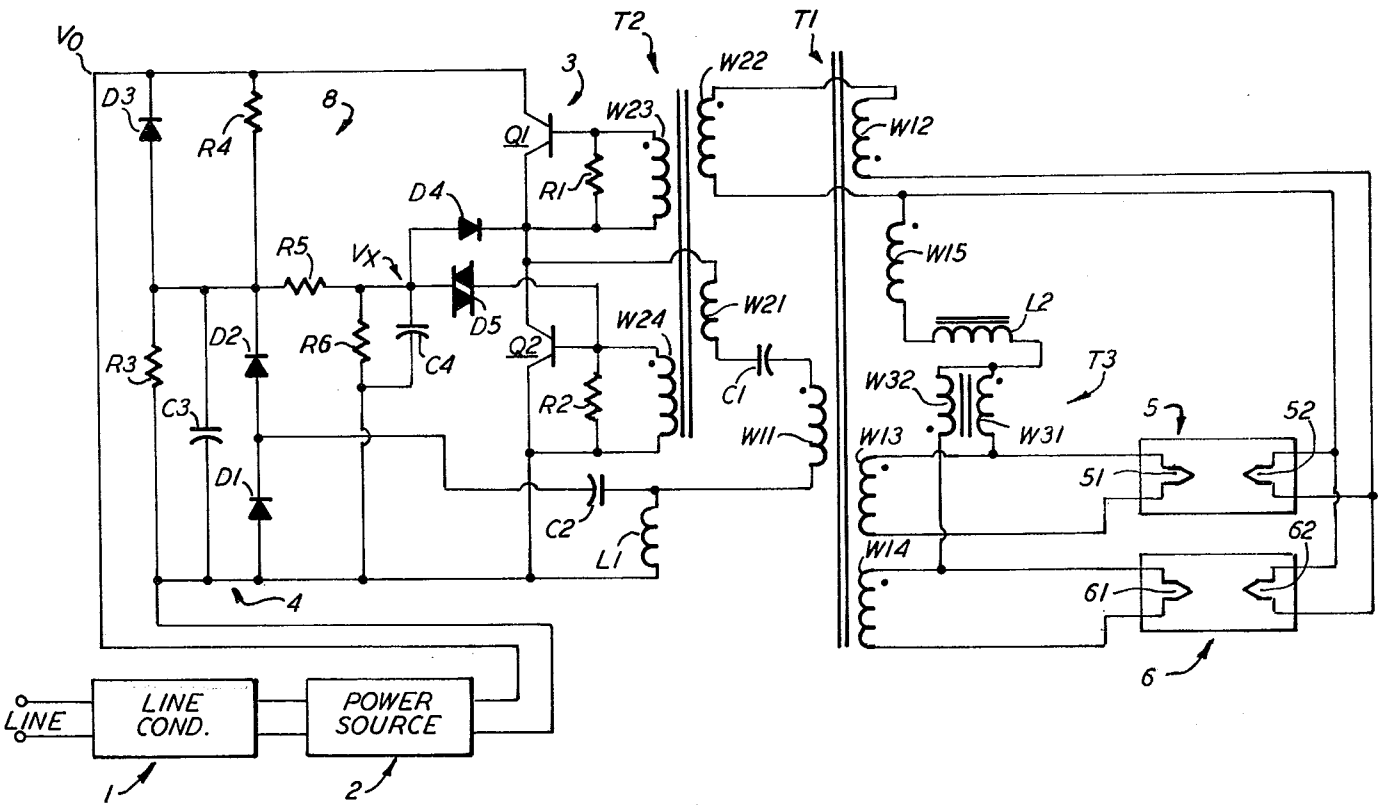
LINE
LINE COND.
POWER SOURCE
1
2
4
6
5
3
8
T1
T2
T3
Q1
Q2
D1
D2
D3
D4
D5
R1
R2
R3
R4
R5
R6
C1
C2
C3
C4
L1
L2
W11
W12
W13
W14
W15
W21
W22
W23
W24
W31
W32
51
52
61
62
VX
VO

TRANSISTOR DRIVE SCHEME FOR FLUORSCENT LAMP BALLAST

CROSS REFERENCE TO RELATED APPLICATIONS

Cross reference is made to the following applications, all assigned to the same assignee and filed on the same date as this application:

"Improved Output Configuration for Electronic Ballast", by William C. Knoll, Ser. No. 218,387, filed Dec. 19, 1980;

"Direct Drive Ballast with Delayed Starting Circuit", by William C. Knoll and David LaRue Bay, Ser. No. 218,386, filed Dec. 19, 1980; and "Dimming Circuit for an Electronic Ballast", by William C. Knoll, Ser. No. 218,311, filed Dec. 19, 1980.

TECHNICAL FIELD

This invention relates to electronic ballast circuitry and more particularly to an improved circuit for driving a pair of matched transistors in a push-pull inverter mode. The circuit improvement relaxes otherwise stringent requirements relating to the transistor switching parameters.

BACKGROUND ART

U.S. Pat. No. 4,188,661, "Direct Drive Ballast With Starting Circuit" by Bruce L. Bower and Raymond H. Kohler, dated Feb. 12, 1980, assigned to the assignee of the present invention, and hereby incorporated by reference, describes an electronic ballast circuit for driving a pair of fluorescent lamps. Central to the operation of that circuit is a high frequency (20 to 30 KHz) inverter comprising two transistors connected in series and operating in a push-pull mode. The inverter drives, via an output transformer, the cathode filaments of the lamps. The output transformer comprises a series-resonant primary winding coupled to the inverter output. The secondary of the output transformer includes one lamp voltage winding and three filament windings. Two filament windings separately supply current to one filament of each of the lamps. The third filament winding supplies current to the remaining two, parallel-connected, filaments. Also included on the secondary of the output transformer is a series connected discrete ballasting inductor in series with a pair of bias windings oppositely poled and connected in series between the first and second filament windings. These windings are arranged so as to establish a voltage differential across the cathodes of the respective lamps sufficient to effect firing of the lamps.

The ballast circuit further includes an interstage transformer having three primary-wound feedback windings each coupled in a loop that includes at least one lamp filament and a filament winding. The secondary of the interstage transformer includes a pair of oppositely-poled drive windings coupled to the push-pull inputs of the inverter. Because the primary windings are coupled in a loop that includes the lamp filaments, they induce a voltage in a secondary proportional to the sum of filament currents. Proper phasing of the secondary windings provides the positive feedback necessary to sustain inverter operation. (A modified feedback arrangement disclosing a single primary winding connected in a loop with the two parallel-connected filaments is disclosed in U.S. Pat. No. 4,127,893, "Tuned Oscillator Ballast Circuit With Transient Compensating Means" by Charles A. Goepel and assigned to the assignee of the present invention. See FIG. 2 of that patent.)

U.S. Pat. No. 4,188,661 also discloses circuitry for enhancing the oscillator startup operation. Upon initial energization of the ballast circuit, a capacitor connected in parallel with one of the secondaries of the interstage transformer is slowly charged through a source of slowly developed DC voltage. When the charge across the capacitor reaches a given magnitude, a series connected diac is switched on thereby discharging the capacitor through a relatively low impedance and causing a transient across one of the drive windings of the interstage transformer. This perturbation supplies base drive to at least one of the inverter transistors and assures oscillator startup. A voltage derived from the current in the primary of the output transformer is applied to the diac in a manner that renders the diac nonconducting during steady state operation of the ballast circuit.

While it cannot be gainsaid that the circuitry disclosed in the patent discussed above represents a substantial advance in the state of the art of ballast design, with regard to both the conventional electromagnetic and the electronic types, the subject invention represents a further substantial advance in that art. In particular the improved output transformer configuration disclosed herein provides, inter alia, improved power efficiency and rapid firing of a dual lamp system.

DISCLOSURE OF THE INVENTION

The above and other objects and advantages are achieved in one aspect of this invention by an improved transistor drive scheme for a fluorescent lamp ballast circuit that includes a transistor inverter having an interstage transformer for applying a feedback signal derived from a lamp filament current to drive the inverter input. The interstage transformer includes a primary winding adapted to be coupled in series with a lamp filament and a pair of oppositely poled secondary windings coupled to the inverter input. An additional winding on the interstage transformer primary is coupled in series with the inverter resonant output circuit loop and develops a phase-feedback signal in proportion to the output loop current. The phase of feedback signal is coupled to an input of the inverter via a secondary winding on the interstage transformer.

The phase feedback signal compensates for errors in inverter drive signal phase or frequency, thereby relaxing otherwise more stringent requirement relating to the inverter switching speed.

BRIEF DESCRIPTION OF THE DRAWING

The sole drawing is a schematic diagram of an electronic ballast circuit employing the subject invention.

DESCRIPTION OF THE PREFERRED EMBODIMENT

For a better understanding of the present invention, together with the objects, advantages and capabilities thereof, refer to the following disclosure and appended claims in conjunction with the accompanying drawing.

Referring now to the drawing, the electronic ballast circuit derives its primary power from the AC line through a line conditioner 1. The line conditioner may include, inter alia, a transient suppressor, overload switch and line filter. See, e.g. U.S. Pat. No. 4,188,661, supra, at column 2, lines 38–48, column 3, lines 36–52, and as illustrated in the drawing as element 5. The output of the line conditioner is coupled to the input of a voltage supply 2 ($V_o$) which provides a nominal output voltage of 300 volts.

The core of the electronic ballast system illustrated in the drawing is the high frequency, push-pull inverter 3 comprising NPN transistors Q1 and Q2. Q1 has a collector connected to the high side of the voltage supply and an emitter connected to the collector of Q2; the emitter of Q2 is in turn connected to the common or ground return of the voltage supply. The base-to-emitter junctions of both Q1 and Q2 are individually coupled by damping resistors, R1 and R2, respectively. The output of inverter 3, that is, the signal at the junction of Q1 emitter and Q2 collector, is coupled through a capacitor C1 to one end of the primary winding, W11, of output transformer T1. A detailed discussion of the construction and operation of T1 is presented below. In a preferred embodiment the output of the inverter is coupled to W11 through a network that includes the series connected of C1 and a phase-feedback winding, W21, on the primary of an interstage transformer T2. The other end of W11 is coupled to the input of what, for present purposes, will be considered a secondary voltage source 4.

Voltage source 4 includes an inductance L1 connected between W11 and the common return. The junction of W11 and L1 is coupled through capacitor C2 to a voltage-doubling peak rectifier that includes diodes D1 and D2, charge storage capacitor C3, and resistor R3. D1 has a cathode connected to C2 and an anode connected to the cathode of D1 and a cathode connected to one side of C3; the other side of C3 is connected to the common return. R3 is connected in parallel with C3. The output of the secondary voltage source 4 is coupled through a diode D3, in the anode-to-cathode direction, to the high side of the primary voltage source 2.

Operation of voltage supply 4 is contingent on the operation of the inverter circuit in the following manner. When operating the inverter develops approximately a 20 KHz square wave at the junction of Q1 and Q2. (The frequency of the output signal is largely determined by the resonant frequency of C1 and W11, the effect of W21 being substantially negligible.) The current flowing in W11 is coupled to the common return through L1, thereby developing a periodic voltage across L1 in proportion to that current. That voltage is coupled through C12 to rectifying diodes D1 and D2. In standard fashion the charge stored in C3 will represent a voltage substantially equal to the peak-to-peak voltage across L1, less losses attributable to the rectification process. Normally the voltage developed by the secondary source 4 will be less than that developed by the primary source 2 so that D3 will be reverse biased, the two sources isolated from each other, and negligible current drawn from the secondary source. However, under low-line or other aberrant conditions, the voltage at the output $V_o$ may drop so significantly that D3 will become forward biased and the secondary source will then be available to power the inverter circuitry.

Startup of the oscillator is assured by a startup circuit 5 that includes a charging resistor R4, voltage divider resistor R5 and R6, a clamping circuit, including clamping diode D4 and clamping capacitor C4, and a semiconductor switch in the form of diac D5.

R4 is coupled from the high side of $V_o$ to one side of C3 so that, subsequent to the energization of the ballast circuit, C3 begins to charge toward the voltage at the output of that source. (To be precise, it will take some time for output of $V_o$ to attain its nominal value but this duration can be expected to be de minimis in comparison with the R4C3 time constant). R5 and R6 are series connected across C3, so that the voltage developed at the junction of R5 and R6, ultimately coupled to D5, will track the exponentially-rising voltage across C3. As illustrated in the drawing D5 has one end coupled to the output of the voltage divider, at the junction of R5 and R6, and the other end coupled to an input of the inverter, at the base of Q2. Neglecting the effect of R3, the voltage, $V_x$, at the output of the voltage divider will increase roughly as $$\frac{R6}{R5 + R6} \times V_o(1 - e - t/R4\ C3).$$

At some time determined by the values of the components represented in that relationship above, $V_x$ will exceed the breakover voltage of D5. D5 will fire, thereby supplying bias current to the base of Q2 and initiating operation of the inverter, after which the inverter will become self-sustaining. The salient advantage of this startup circuit is that startup of the inverter is inhibited until C3 of the secondary voltage source has become charged. As a result the inverter transistors are spared some deleterious effects attendent the initial current surge required to charge C3.

The startup circuit also includes a clamping circuit comprising D4, with a cathode connected to the inverter output and an anode connected to the voltage divider output, and C4, connected from there to ground. The clamping action of D4 and C4 prevents the inverter square wave output from randomly firing D5. In effect, the clamping circuit disables the starting circuit during steady state inverter operation so that Q1 and Q2 are not subjected to transients that might result from the random firing of D5.

As illustrated in the drawing, the output of the inverter is coupled to T1 and drives a pair of fluorescent lamps, 5 and 6, having filaments 51 and 52 and 61 and 62, respectively. Filament current is supplied by secondary-wound filament windings W12, W13 and W14 on the secondary of the output transformer T1. Each of the filament windings is arranged to form a circuit loop with at least one filament of a lamp. W13 forms a loop with filament 51, W14 with filament 61, and W12 with the parallel-connected filaments 52 and 62. A bias winding, W15, on the secondary of T1 has a first end coupled to filaments 51 and 61, through a discrete ballasting inductor (L2) and oppositely poled bias windings (T3) and a second end coupled to filaments 52 and 62. The bias winding establishes the necessary voltage differential across the filaments of lamps 5 and 6 to generate ignition of both lamps.

As illustrated in the drawing the bias winding W15 is coupled to filament windings 51 and 52 through an inductance L2 and a differential transformer T3. One end of L2 is connected to the second end of W15 and the other end is connected to a common terminal of T3. T3 includes first and second oppositely-poled windings, W31 and W32. W31 and W32 each have one end coupled to the common terminal of T3 and the other ends respectively coupled to filaments 51 and 61. T3 comprises approximately 100 turns of #28 wire wound on a 3/16-inch "double-E" core, Ferroxcube type 813.

T3 operates to enhance the firing of cold lamps. Assuming that one of the lamps fires initially, there will be a sudden increase in current through either winding W21 or winding W32, depending on whether lamp 5 or lamp 6 has fired. Assuming lamp 5 has fired the current surge in winding W31 will induce a voltage in winding W32. Because W31 and W32 are oppositely poled, the voltage induced in W32 will add to the voltage developed by bias winding W15, thereby assuring that lamp 6 will fire soon after lamp 5. Of course, the opposite would be true should lamp 6 fire before lamp 5.

L2, coupled between W15 and T3, is included to provide the proper series reactance for lamp ballasting. L2 comprises approximately 75 turns, 15-#36 Litz wire wound on a Ferroxcube core as specified above.

The necessary feedback to sustain inverter oscillation is provided by interstage transformer T2. T2 includes a primary-wound feedback winding W22 and oppositely poled secondary-wound drive windings W23 and W24. As shown in the drawing W22 is part of a circuit loop that includes filament winding W12 and parallel-connected filaments 52 and 62. Therefore, the current that flows through those filaments must necessarily flow through W22 as well. This signal is fed back to W23, coupled across the base-to-emitter junction of Q1, and W24, coupled across the base-to-emitter junction of Q2, in phase opposition (by virtue of polarity of those windings) so as to effect push-pull operation of the inverter.

As alluded to above, T2 also includes a winding W21 in series with the inverter's series resonant network, W11 and C1. W21, comprising approximately 5 to 10 turns, #36 wire, allows some relaxation of the switching parameter requirements of transistors Q1 and Q2. In particular, the switching speeds of transistor Q1 and Q2 need not be as closely matched as would be required in the absence of W21, and, therefore, less expensive transistors will be sufficient. This is because a small amount of the C1–W11 loop current is fed back to Q1 and Q2 as a function of the inverter operating frequency, thereby compensating for variations in the switching speeds of Q1 and Q2.

Accordingly, while there has been shown and described what at present is considered to be the preferred embodiment of an improved output configuration for an electronic ballast circuit, it will be obvious to those skilled in the art that various changes and modifications may be made therein without departing from the invention as defined by the appended claims.

INDUSTRIAL APPLICABILITY

This invention is useful in electronic ballast systems for fluorescent or other types of lamps.

What is claimed is:

1. In an electronic ballast circuit including a transistor inverter and an interstage transformer, said interstage transformer including a first primary winding adapted to be coupled in series with at least one lamp filament for developing a feedback signal derived from the filament current and including at least one secondary winding coupled to an input of the inverter, an improved transistor drive scheme including a phase-feedback winding on the primary of the interstage winding, said phase feedback winding coupled in series with an inverter output circuit loop for developing a phase-feedback signal in proportion to the output circuit loop current, which phase feedback signal is coupled to an input of the inverter via a secondary winding on the interstage transformer.

2. In an electronic ballast circuit for providing current to a lamp filament, said ballast circuit including an inverter, an output transformer having a primary winding coupled to the inverter output and at least one secondary winding adapted to supply current to a lamp filament, and an interstage transformer having a primary winding adapted to be coupled in a loop with at least one filament and a secondary winding of the output transformer so as to develop a filament feedback signal in proportion to a filament current and having a secondary winding coupled to an inverter input, the improvement comprising a phase-feedback winding on primary of the interstage transformer and coupled in series with the inverter output circuit loop for developing a phase-feedback signal derived from the output loop current.

* * * * *